US006513704B1

(12) United States Patent
Perot

(10) Patent No.: US 6,513,704 B1
(45) Date of Patent: Feb. 4, 2003

(54) PACKAGING BOX FOR BOTTLES

(76) Inventor: Nicolas Perot, Les Tuileries, 16430 Champniers (FR)

( * ) Notice: Subject to any disclaimer, the term of this patent is extended or adjusted under 35 U.S.C. 154(b) by 0 days.

(21) Appl. No.: 10/059,178

(22) Filed: Jan. 31, 2002

(51) Int. Cl.[7] ..... B65D 5/00

(52) U.S. Cl. ..... 229/104; 229/5.5; 229/117.06; 229/405

(58) Field of Search ..... 229/5.5, 89, 104, 229/117.05, 117.06, 405; 220/737, 738, 739

(56) References Cited

U.S. PATENT DOCUMENTS 2,300,473 A * 11/1942 Van Winkle ..... 229/5.5
3,511,428 A * 5/1970 Dilot ..... 229/104
3,912,331 A * 10/1975 Turner et al. ..... 229/104
4,109,848 A * 8/1978 Kipp et al. ..... 229/104
4,166,568 A * 9/1979 Swan ..... 229/5.5
4,792,086 A * 12/1988 Chen ..... 229/117.05
6,059,140 A * 5/2000 Hicks ..... 220/739
6,170,740 B1 * 1/2001 Clark ..... 229/104
6,290,091 B1 * 9/2001 Bell ..... 229/405

FOREIGN PATENT DOCUMENTS

GB 2231557 A * 11/1990 ..... 229/117.05

* cited by examiner

*Primary Examiner*—Gary E. Elkins
(74) *Attorney, Agent, or Firm*—Millen, White, Zelano & Branigan, P.C.

(57) ABSTRACT

The packaging box for bottles is made from a blank in a flexible foldable material that comprises two similar body panels which are foldable against each other about a lateral generatrix and that form together a side wall for said box when their remote side edges are secured together, so that said box can be shelved flat in a collapsed form. The blank further comprises two symetrical bottom elements having the shape of a half-section of the bottom face of said box, with two bottom flaps connected each along the diameter of one of said bottom elements. The two bottom flaps are securable flat on each other into a grip for pushing said bottom elements into said side wall where they are blocked by jamming, thereby erecting said box, that further constitutes a strengthening element for said bottom face of said box.

19 Claims, 4 Drawing Sheets

PACKAGING BOX FOR BOTTLES

The present invention relates to a packaging box intended to protect bottles during their transportation and handling, and which is suited to be used for the presentation of the product contained in the bottles, in places where goods for sale are displayed.

BACKGROUND OF THE INVENTION

The bottles containing drinks of high quality, such as fine wine and liqueurs, are often sold individually, each being put in a packaging of its own, the purpose of which is first of all to protect the bottle during its transportation and handling, but that also most often presents an esthetic character. Of course, the invention is not restricted to the field of wine and spirits, nor to that of drinks in general, and it can be applied in many other domains, which take benefit of the same means performing the same functions. The invention can also be used as a packaging box for any type of bottle or other container, whatever the physical or chemical nature of its content.

Normally, unflexible tubes made of cardboard or a similar material, that may present some parts for example in metal, are used. These packagings are designed to offer a good protection for the bottle, but stocking them in the production sites requires considerable space and highly increases the costs.

Besides, packaging boxes are known which are formed from blanks made of cardboard or a similar material and that present predetermined fold lines. Heretofore, such boxes always showed a rectangular or square section when they could be shelved flat, generally in the shape of simple blanks in a single layer which were then erected, together with producing a bottom and eventually a cover, just before the packaging step. The process of construction of these boxes is relatively complex and it is time-consuming. Furthermore, it is difficult to obtain a solid bottom that will not come apart during transportation or handling.

It is therefore desirable to have a packaging box for bottles that provides a reliable protection, especially concerning the strength of its bottom, that can be collapsed so as to be shelved flat, and the erection of which is easy and quick to carry out.

SUMMARY OF THE INVENTION

For such purpose, the present invention provides a packaging box for bottles, made from a blank in a flexible foldable material such as cardboard comprising: two similar body panels which are foldable against each other about a lateral generatrix and that form together a side wall for the box when their remote side edges are secured together, so that the box can be shelved flat in a collapsed form, two symetrical bottom elements having the shape of a half-section of the bottom face of the box, each of the bottom elements being foldably connected respectively to one of the body panels, and a bottom flap foldably connected along a diameter of said bottom face at a free edge of each of the bottom elements. The two bottom flaps are securable flat on each other into a grip for pushing the bottom elements into the side wall, where they are blocked by jamming, thereby erecting the box, and further constituting a strengthening element for the bottom face of the box.

The packaging box according to the invention can be shelved flat in a collapsed state, and therefore does not require a large storing space. Its erection is carried out by a straight-forward and quick manual operation and the blocking effect obtained by jamming of the two bottom elements into the side wall gives rise to a rigid bottom that will not get out of shape or come apart.

Advantageously, each of the bottom elements is attached respectively to the body panels through an intermediate laterally strengthening panel, that is substantially of the same width as the bottom flaps, and which is folded towards the inside of the side wall, so that the bottom elements are retracted in the side wall and the free edge of each of the intermediate panels forms, with the lower edge of the side wall, a support base for the box.

Owing to this layout, a particularly strong laterally reinforced bottom is obtained. Furthermore, the support base of the box comprises a diagonal component constituted by the edges of the two bottom flaps, which provides a reliable support base.

According to a further feature of the invention, the remote side edges of the body panels are secured to each other through an attaching panel connected to the outer vertical side edge of one of the body panels and secured to the outer vertical side end of the other body panel. Furthermore, one of the intermediate panels is cut out from a length which is substantially equal to the width of the attaching panel. This layout makes it possible to avoid an overthickness at the bottom of the packaging box.

Each body panel may comprise, next to each of its vertical side edges, a fold line parallel to the edge, so that the box has an oval or elliptic section. The erection of the box is then facilitated, and is carried out by applying an inward pressure at both ends of the major axis of the section of the box.

The body panels may have the shape of a rectangular trapezium, to provide a box with a frustoconical shape. This layout allows a better positioning of the boxes next to each other without any gap between them, when an arrangement of square formation is required. However, most often, a circular section throughout the entire height of the box will be preferred.

Advantageously, the bottom flaps comprise on both vertical side edges a non-secured extension that folds towards the flaps during the erection of the box. Those two extensions reinforce the support base of the box at the ends of the bottom flaps, which is particularly advantageous in the case of packaging boxes with a bottom face of an oval lower section, and even more of a circular lower section.

According to a further feature of the invention, in the case of a box with a circular upper section, each body panel is connected to a median cover element having the shape of a half-section of the top face of the box. The cover is obtained by folding the two cover elements inwardly into the top part of the box.

Advantageously, each cover element comprises two half-sections joined by a strip into which is arranged a central aperture, and each cover element comprises an insertion flap projecting out of the diameter of one of its half-sections, which insertion flap is intended to engage itself in the aperture of the other cover element. The two insertion flaps are situated on opposite half-sections of the cover elements.

This gives rise to a double-walled cover, the two elements of which are blocked in one another. Such a cover will not come apart during transportation or handling of the box.

Advantageously, each aperture comprises, on its side opposite to the insertion flap of the corresponding cover element, two shoulders for centring the flap of the other cover element. This still improves the cover strongness.

In the case of a box with a square or rectangular upper part, three upper strengthening flaps and a cover element may be connected to the upper edge of the side wall.

All the elements belonging to the blank are connected together by fold lines. This facilitates the erection of the box.

BRIEF DESCRIPTION OF THE DRAWINGS

Other advantageous features of the invention will appear from the following description of preferred embodiments, referring to the accompanying drawings, in which.

Figure 1:
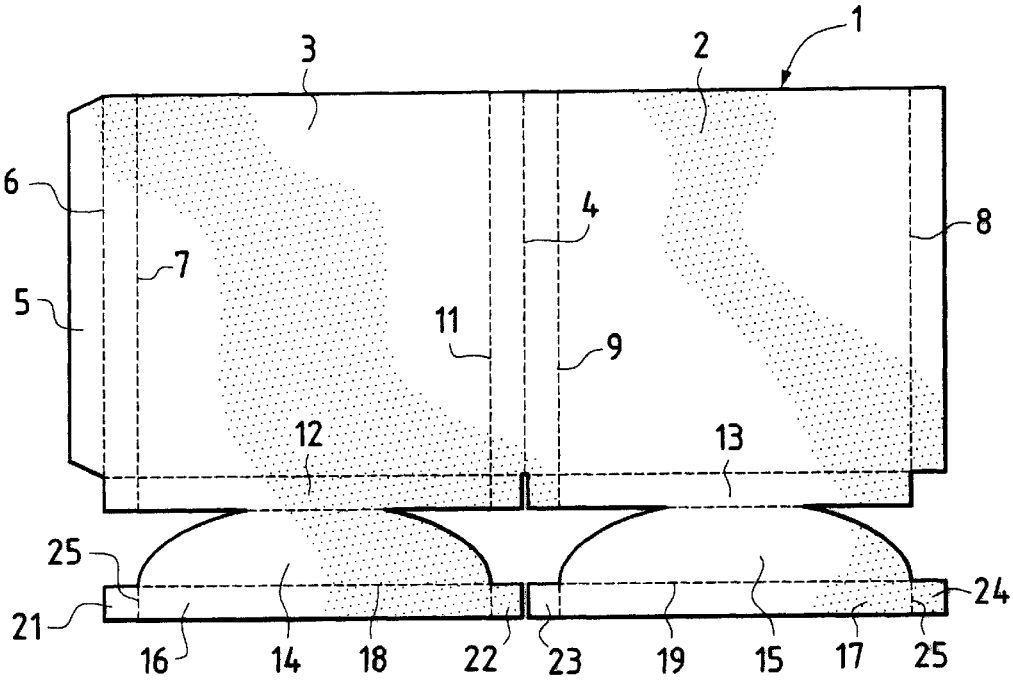
FIG. 1 is a plan view of a blank intended to form a packaging box with an oval cross-section.

On these drawings, the dotted lines represent the fold lines.

DETAILED DESCRIPTION OF THE INVENTION

FIGS. 1 to 4 relate to a packaging box with an oval section. This box is formed from a blank cut out in a sheet of cardboard and comprising fold lines. That blank consists of a side wall comprising two similar body panels 2 and 3 separated by a median fold line 4 which is a lateral generatrix of the side wall. One of these body panels 3 is connected on its outer vertical side edge to an attaching panel 5, along a fold line 6.

Other fold lines 7, 8, 9 and 11 are situated respectively close to each of the outer vertical side edges of the side wall and close to the median fold line 4, on either side of the latter.

Each body panel 2 and 3 of the side wall comprises along its bottom edge an intermediate laterally strengthening panel 12, respectively 13. The intermediate panel 13, attached to the body panel 2 that is not connected to the attaching panel 5, is cut out from a length that is substantially equal to the width of the attaching panel 5. The fold lines 7, 9 and 11 extend on the intermediate panels 12 and 13.

To each of the intermediate panels 12 and 13 is attached a bottom element, shown under reference 14 or 15 respectively, the shape of which corresponds to a half-section of the bottom face of the box to be formed. A bottom flap 16 or 17 respectively is foldably connected to each of the bottom elements 14 or 15 respectively at a free edge thereof along a diameter of said bottom face of the box. It is foldably connected thereon along a fold line 18 or 19 respectively. Each of the bottom flaps 16 and 17 comprises, on its outer vertical side edges, an extension 21, 22, 23, 24, that is attached thereon along a vertical fold line 25.

In order to get a ready-to-use packaging box in a flat state, the two body panels of blank 1 are folded one on the other by folding along the median fold line 4, and the attaching panel 5 is sticked with glue to the outer vertical side end of body panel 2, inside the side wall. The intermediate panels 12 and 13 are folded inwardly into the side wall, and the bottom elements 14 and 15 are folded towards the opposite direction. The two bottom flaps 16 and 17 are sticked or bonded together and the intermediate panels 12 and 13 are sticked with glue or otherwise secured to the inside of the side wall, at the bottom of the box.

Figure 2:
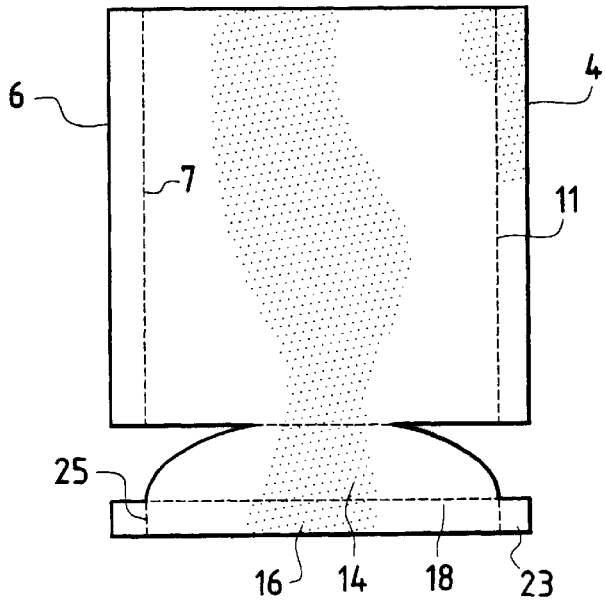
FIG. 2 is a plan view of the blank of FIG. 1 after being folded on itself and glued to form a collapsed packaging box that can be shelved flat.

FIG. 2 illustrates the blank, as folded on itself and bonded with glue, such as is thus obtained.

Figure 3:
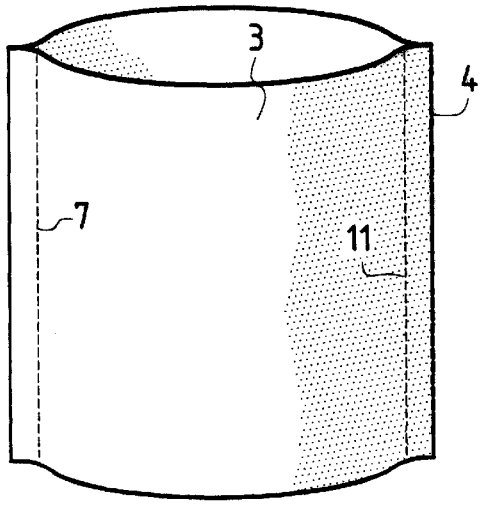
FIG. 3 is a perspective view of the erected packaging box obtained.

In order to erect the packaging box with an oval section which is represented in FIG. 3, the two body panels are slightly drawn away from one another and the two bottom flaps 16 and 17, which are sticked together, are pushed inwardly into the bottom part of the box. The bottle to be packed is introduced through the top of the box, the inner section of which is fitted to the outer section of the bottle, so that there is created a piston effect that slows down the descending motion of the bottle inside the box, Actually, the bottle, when in the full state, slides downwards by itself inside the box because of its weight, and it comes into contact with the bottom elements 14 and 15 folded inside the box, that constitute a bottom face for the box.

For a better understanding of the structure of the bottom face of the box, its different elements are represented in FIG. 1 as they are cut in the original blank, although in the box for sale they are actually in contact, and some of them are even bonded together. The two body panels 2 and 3 and the fold line 4 are represented, as well as the attaching panel 5 which is glued onto the outer vertical side end of body panel 2, in the inside of the box. The edges of the intermediate panels 12 and 13 which are folded onto the body panels 2 and 3, the two bottom elements 14 and 15, and the edges of the bottom flaps 16 and 17 which are glued on one another, are also represented. The extensions 21, 22, 23 and 24 of bottom flaps 16 and 17 are folded in such a way as to strengthen the support base of the box, at the ends of the major axis of the bottom face of the box.

Figure 5:
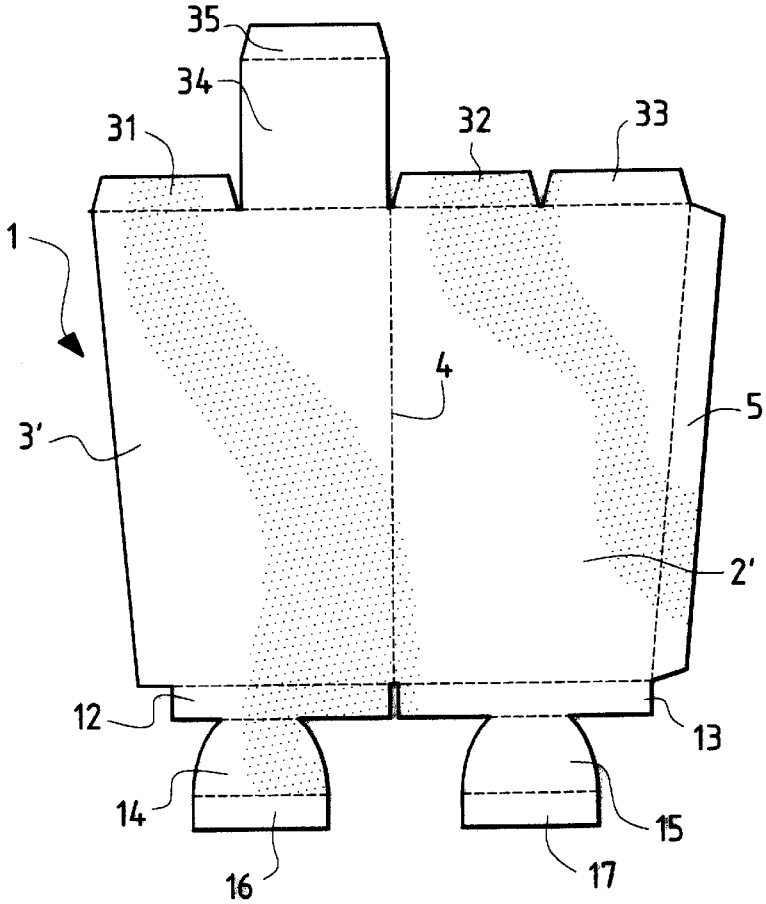
FIG. 5 is a plan view of a blank intended to form a packaging box of circular lower section and square upper section.

FIG. 5 is a plan view of a blank intended to form a packaging box with a circular lower section and a rectangular upper section. The side wall is constituted of two body panels 2' and 3' of the shape of a rectangular trapezium. As a result, the side wall has the shape of an isosceles trapezium, the upper base of which is larger, and the packaging box thus obtained is fitted for a bottle with a circular section and a frustoconical shape, its diameter increasing towards the top.

This blank comprises the median fold line 4, the attaching panel 5, the fold line 6, the two intermediate laterally strengthening elements 12 and 13, the two bottom elements 14 and 15, and the two bottom flaps 16 and 17.

On its upper end, the blank 1 of FIG. 5 comprises three upper strengthening flaps 31, 32 and 33 and a cover element 34 comprising a flap 35.

Figure 6:
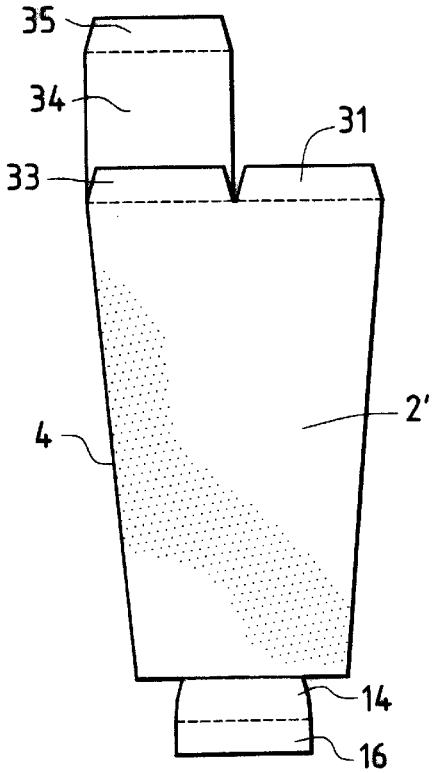
FIG. 6 is a plan view of the blank of FIG. 5 after being folded on itself and glued.

The construction of the box of FIGS. 5 to 8 is carried out in a manner similar to that used for the box of FIGS. 1 to 4. The attaching panel 5 is sticked to the inner side of body panel 3' and the two bottom flaps 16 and 17 are glued to one another. The two intermediate panels 12 and 13 are folded inwardly into the box and may be glued to the inside of the side wall. The collapsed box illustrated in FIG. 6 is thereby obtained. This box can be shelved flat until it is used for receiving a bottle.

The erection of the box is realised in the same way as for the preceding example, by grasping the bottom flaps 16 and 17 and pushing the bottom elements 14 and 15 inside the box, where they is are blocked by jamming. The opened-up or erected box illustrated in FIG. 7 is thus obtained.

Figure 4:
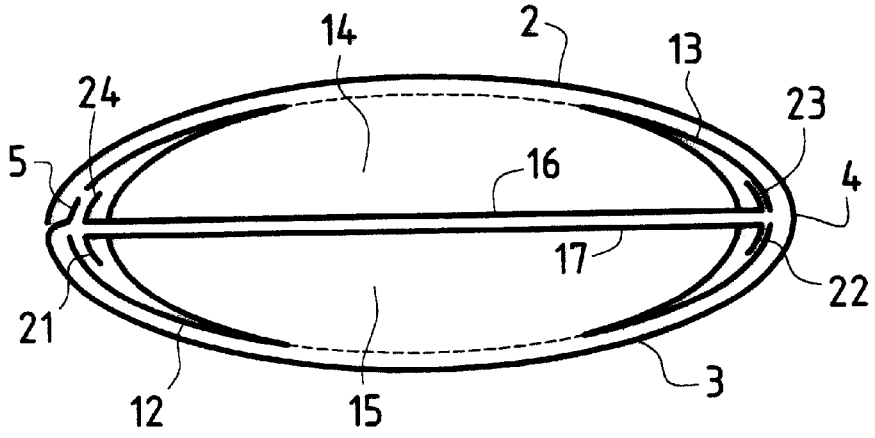
FIG. 4 is a bottom plan view of the box of FIG. 3.
Figure 8:
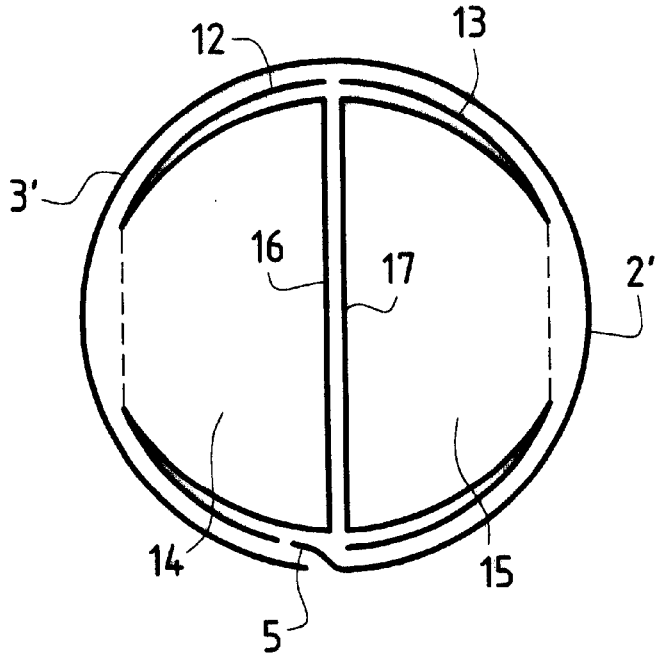
FIG. 8 is a bottom plan view of the box of FIG. 7.

FIG. 8 is analogous to FIG. 4, and all the components of the bottom face of the box are represented thereon.

Figure 7:
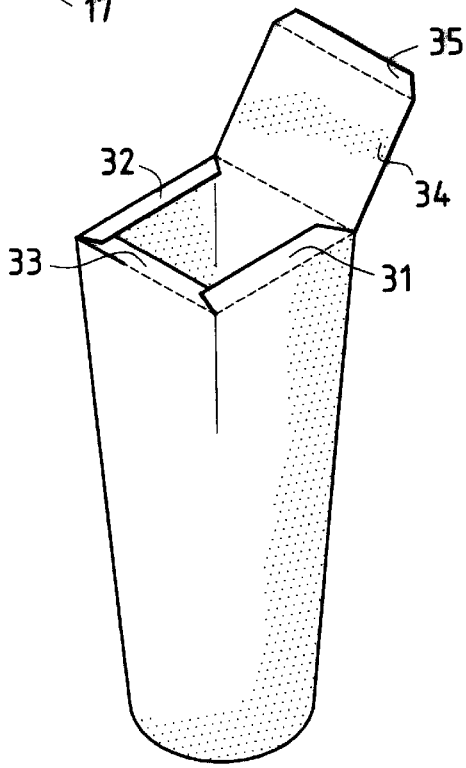
FIG. 7 is a perspective view of the erected packaging box obtained.

As can be seen from FIG. 7, a box with a circular lower section and a rectangular upper section is formed. This shape allows a better positioning of the boxes when several ones are packed in a same packaging element such as a case : due to the square shape of their upper part, the boxes are arranged with their upper parts being contiguous, and in consequence they cannot move or slide against one another.

Figure 9:
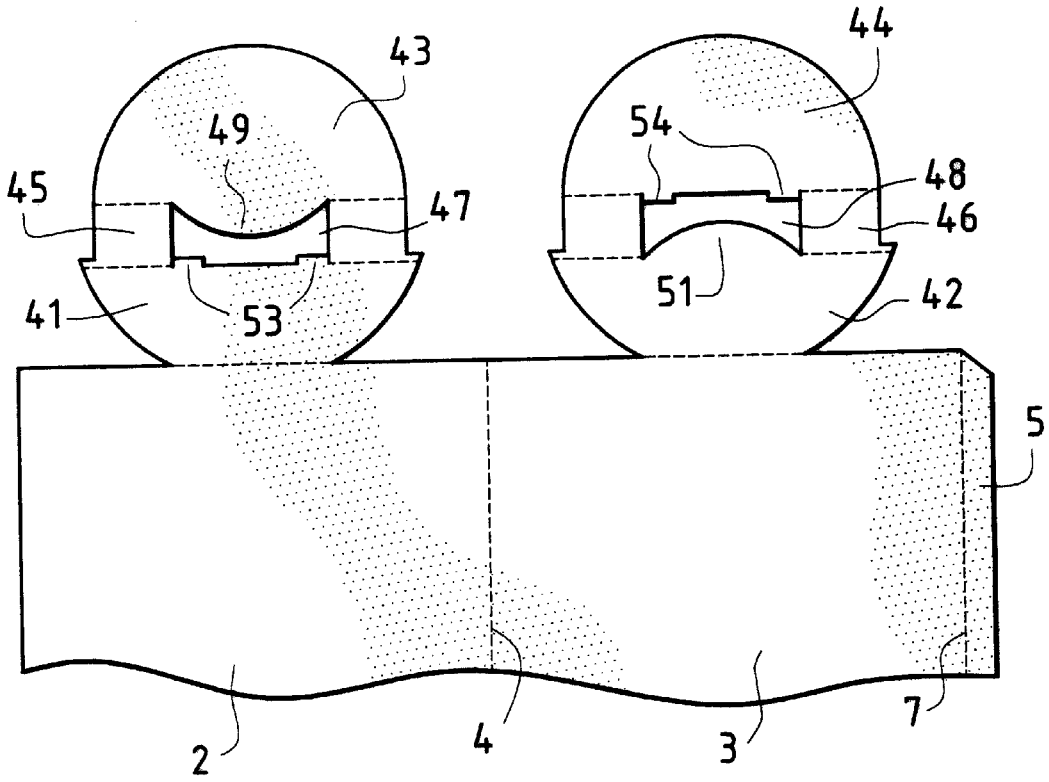
FIG. 9 is a partial view of the upper part of a blank intended to form a box of circular cross-section comprising a double cover.
Figure 10:
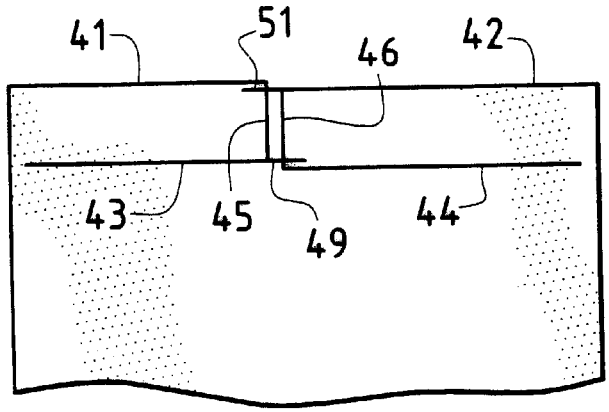
FIG. 10 is a partial sectional view of the upper part of the box formed from the blank of FIG. 9.

FIGS. 9 and 10 illustrate another embodiment for the cover in the preferred case of a box with a circular upper section. The blank 1 comprises along its top edge two semi-circular cover elements 41 and 42, which are pushed towards the inside of the box when the latter has been erected and the bottle has been introduced in it. The two cover elements 41 and 42 come into contact together by their diameter and they close the top part of the box.

In the embodiment illustrated in FIG. 9, each cover element comprises another semi-circular cover element, numbered 43 or 44 respectively, that is attached to the first cover element by a strip 45 or 46 respectively.

In each of the strips 45 and 46 is situated a central aperture 47, or respectively 48. The upper cover element 43 comprises an insertion flap 49 projecting into the aperture 47. In a similar way, the lower cover element 42 comprises an insertion flap 51 projecting into the aperture 48. On its side opposite to flap 49 (or respectively 51), the aperture 47(or respectively 48) comprises two centering shoulders 53 or respectively 54.

That complete structure leads to a much more solid, double-walled, cover, as shown in FIG. 10. For that purpose, once the bottle has been introduced into the box, the two strips 45 and 46 and the two outer cover elements 43 and 44 are folded to a right angle, so that the two cover elements 41 and 43, respectively 42 and 44, are parallel to one another. The insertion flap 49 of the upper cover element 43 is inserted into the aperture 48 of strip 46 in a similar way, the insertion flap 51 of the lower cover element 42 is inserted into the aperture 47 of strip 45. There is thus provided a double-locking of the two cover sets one into the other, and the locking is even improved by the centering of each insertion flap 49 or respectively 51 between the shoulders 54 or respectively 53.

That general structure of a cover comprising two half-sections may also be used to make up a handle.

Advantageously, the fold lines of the side wall are made with a tracing tool making a cut down to the half-thickness of the wall. This facilitates the folding of the side wall. On the contrary, the other fold lines of the bottom and the cover are made with a slotting tool that flattens the cardboard to produce a slot. The slot lines are less easily folded than the traced lines and they tend to oppose an elastic resistance similar to a spring effect.

As can be clearly understood from the above description, the invention makes it possible to produce packaging boxes for bottles with a rigid structure that can stand transportation and handling. Once the blanks used to form the boxes have been folded on themselves and glued, the boxes can be shelved flat and they shox little hindrance.

The erection of the boxes is carried out in a simple and fast manner, while ensuring a good rigidity of the bottom and, if desirable, of the cover.

The invention preferably applies to boxes with a circular or oval or elliptic section, as well as to those with a frustoconical shape that widens towards the top. However, the embodiments described above are only given as examples, and it is clear that many modifications and variations can be made without departing from the scope of the present invention. In particular, flexible materials other than cardboard can be used, especially sheets of synthetic polymer materials such as polyvinyl chloride. Besides, rather than glued, the bottom flaps can be secured together by any other suitable means well-known in the art. The same applies for the bonding of the attaching panel and of the intermediate panels to the side wall.

What is claimed is:

1. A packaging box for bottles, made from a blank in a flexible foldable material, such as cardboard comprising two similar body panels which are foldable against each other about a lateral generatrix and that form together a side wall for said box when their remote side edges are secured together, whereby said box can be shelved flat in a collapsed form, two symetrical bottom elements having the shape of a half-section of the bottom face of said box, each of said bottom elements being foldably connected respectively to one of said body panels, a bottom flap foldably connected to each of said bottom elements along a diameter of said bottom face at a free edge of each respective bottom element, the two bottom flaps being securable flat on each other along said diameter into a grip for pushing said bottom elements into said side wall, where they are blocked by jamming, thereby erecting said box, and further constituting a strengthening element for said bottom face of said box.

2. A packaging box as claimed in claim 1, wherein each of said bottom elements is attached respectively to said body panels through an intermediate laterally strengthening panel, that is substantially of the same width as said bottom flaps, and which is folded towards the inside of said side wall and secured thereon, so that said bottom elements are retracted in said side wall and the free edge of each of said intermediate panels forms, with the lower edge of said side wall, a support base for said box.

3. A packaging box as claimed in claim 1, wherein the remote side edges of said body panels are secured to each other through an attaching panel connected to the outer vertical side edge of one of said body panels and secured to the outer vertical side end of the other body panel.

4. A packaging box as claimed in claim 2, wherein the remote side edges of said body panels are secured to each other through an attaching panel connected to the outer vertical side edge of one of said body panels and secured to the outer vertical side end of the other body panel, and wherein one of said intermediate panels is cut out from a length which is substantially equal to the width of said attaching panel.

5. A packaging box as claimed in claim 1, wherein said bottom flaps comprise on both vertical side edges a non-secured extension that folds towards said flaps during the erection of said box.

6. A packaging box as claimed in claim 1, wherein said body panels have the shape of a rectangular trapezium, whereby said box has a frustoconical shape.

7. A packaging box as claimed in claim 1, wherein each body panel comprises, next to each of its vertical side edges, a fold line parallel to said edge, whereby said box has an oval section.

8. A packaging box as claimed in claim 1, wherein three upper strengthening flaps and a cover element are connected to the upper edge of said side wall.

9. A packaging box as claimed in claim 1, wherein each of said body panels is connected to a median cover element having the shape of a half-section of the top face of said box.

10. A packaging box as claimed in claim 9, wherein each cover element comprises two half-sections joined by a strip into which is arranged a central aperture, and wherein each cover element comprises an insertion flap projecting out of the diameter of one of its half-sections, which insertion flap is intended to engage itself in the aperture of the other cover element, the two insertion flaps being situated on opposite half-sections of said cover elements.

11. A packaging box as claimed in claim 10, wherein each aperture comprises, on its side opposite to the insertion flap of the corresponding cover element, two shoulders for centring the flap of the other cover element.

12. A packaging box as claimed in claim 1, wherein the side wall section is fitted to that of the bottle to be packed, at least substantially close to its bottom.

13. A packaging box as claimed in claim 1, wherein all the elements belonging to said blank are connected together by fold lines.

14. A packaging box for bottles that is made of a blank in a flexible foldable material and comprises, when in an easily erectable collapsed state:

two similar body panels folded against each other about a lateral generatrix and that form together a side wall for said box, two symetrical bottom elements having the shape of a half-section of the bottom face of said box, a bottom flap foldably connected to each of said bottom elements along a diameter of said bottom face at a free edge of each respective bottom element, the two bottom flaps being secured flat on each other, each of said bottom flaps comprising on both vertical side edges a non-secured extension, an attaching panel connected to the outer vertical side edge of one of said body panels and secured to the outer vertical side end of the other body panel, inside said side wall, and two intermediate laterally strengthening panels that are substantially of the same width as said bottom flaps, each of said intermediate panels connecting one of said bottom elements and one of said body panels, and which are folded towards the inside of said side wall and secured thereon, one of said intermediate panels being cut out from a length which is substantially equal to the width of said attaching panel, all said panels, flaps and elements in said blank being connected together by fold lines.

15. A packaging box as claimed in claim 14, wherein the side wall section is fitted to that of the bottle to be packed, at least substantially close to its bottom.

16. A packaging box as claimed in claim 14, wherein each body panel comprises, next to each of its vertical side edges, a fold line parallel to said edge, whereby said box has an oval section.

17. A packaging box as claimed in claim 14, wherein each body panel is foldably connected to a median cover element having the shape of a half-section of the top face of said box, each cover element comprising two half-sections foldably joined by a strip into which is arranged a central aperture, and an insertion flap projecting out of the diameter of one of its half-sections, which insertion flap is intended to engage itself in the aperture of the other cover element, the two insertion flaps being situated on opposite half-sections of said cover elements, and wherein each aperture comprises, on its side opposite to the insertion flap of the corresponding cover element, two shoulders for centring the insertion flap of the other cover element.

18. A packaging box for bottles, in a collapsed state, easily erectable, made from a blank in a flexible foldable material such as cardboard comprising two similar body panels having the shape of a rectangular trapezium, folded against each other about a lateral generatrix, and that form together a side wall for said box, two symetrical bottom elements having the shape of a half-section of the bottom face of said box, a bottom flap connected along a diameter of said bottom face to each of said bottom elements, the two bottom flaps being secured flat on each other, an attaching panel connected to the outer vertical side edge of one of said body panels and secured to the outer vertical side end of the other body panel, inside said side wall, two intermediate laterally strengthening panels that are substantially of the same width as said bottom flaps, each of said intermediate panels connecting one of said bottom elements and one of said body panels, and which are folded towards the inside of said side wall and secured thereon, one of said intermediate panels being cut out from a length which is substantially equal to the width of said attaching panel, and three upper strengthening flaps and a cover element connected to the upper edge of said side wall, all panels, flaps and elements in said blank being connected together by fold lines.

19. A packaging box as claimed in claim 18, wherein the side wall section is fitted to that of the bottle to be packed, at least substantially close to its bottom.

* * * * *